US008674787B2

(12) United States Patent
Bradley et al.

(10) Patent No.: US 8,674,787 B2
(45) Date of Patent: Mar. 18, 2014

(54) PLURAL PHASE SHIFTER ASSEMBLY HAVING WIPER PCBS MOVABLE BY A PIVOT ARM/THROW ARM ASSEMBLY

(75) Inventors: Eddie R. Bradley, Richardson, TX (US); Calvin Dickerson, Garland, TX (US); Derek Rodger, Fife (GB)

(73) Assignee: Andrew LLC, Hickory, NC (US)

( * ) Notice: Subject to any disclaimer, the term of this patent is extended or adjusted under 35 U.S.C. 154(b) by 268 days.

(21) Appl. No.: 12/702,633

(22) Filed: Feb. 9, 2010

(65) Prior Publication Data

US 2011/0063049 A1 Mar. 17, 2011

Related U.S. Application Data

(60) Provisional application No. 61/242,240, filed on Sep. 14, 2009.

(51) Int. Cl.
*H01P 1/18* (2006.01)

(52) U.S. Cl.
USPC ..... 333/161; 333/260; 342/375; 439/63; 439/464; 439/581

(58) Field of Classification Search
USPC ..... 333/161, 156, 139, 260; 342/372, 375; 439/63, 449, 464, 470, 471, 473, 581, 439/584, 585
See application file for complete search history.

(56) References Cited

U.S. PATENT DOCUMENTS

| | | | | |
|---|---|---|---|---|
| 5,532,659 | A * | 7/1996 | Dodart | 333/260 |
| 7,463,190 | B2 * | 12/2008 | Zimmerman | 342/372 |
| 2002/0135524 | A1 * | 9/2002 | Zimmerman et al. | 343/760 |

* cited by examiner

*Primary Examiner* — Benny Lee
(74) *Attorney, Agent, or Firm* — Husch Blackwell LLP

(57) ABSTRACT

An improved phase shifter assembly is provided. The phase shifter assembly may comprise first and second sub-assemblies with certain common actuating elements. In one example, a first phase shifter sub-assembly is provided, the first phase shifter sub-assembly including a first phase shifter carrier, a first phase shifter printed circuit board mounted on the first phase shifter carrier, a first wiper printed circuit board coupled to an input of the first phase shifter printed circuit board and having at least a first end coupled to transmission lines on the first phase shifter printed circuit board, and at least one wiper support mechanically coupling the first wiper printed circuit board to the first phase shifter printed circuit board. A second phase shifter is similarly provided. Common actuating elements may include a pivot arm and a throw arm. The pivot arm may be rotatably mounted in the phase shifter assembly and be configured to engage a wiper support of at least one of the first and second phase shifter sub-assemblies. The throw arm may be mounted such that when the throw arm is moved linearly, the pivot arm rotates around a pivot.

23 Claims, 14 Drawing Sheets

PLURAL PHASE SHIFTER ASSEMBLY HAVING WIPER PCBS MOVABLE BY A PIVOT ARM/THROW ARM ASSEMBLY

CROSS-REFERENCE TO RELATED APPLICATIONS

The present invention claims priority to U.S. Provisional Patent Application No. 61/242,240 filed Sep. 14, 2009 titled: "Phase Shifter Design Improvements."

FIELD OF THE INVENTION

The field of the invention relates generally to improvements in phase shifter assemblies, including improvements to manufacturing, durability, and cost reduction.

BACKGROUND OF THE INVENTION

Wireless mobile communication networks continue to evolve given the increased traffic demands on the networks, the expanded coverage areas for service and the new systems being deployed. Cellular ("wireless") communications networks rely on a network of base station antennas for connecting cellular devices, such as cellular telephones, to the wireless network. Many base station antennas include a plurality of radiating elements in a linear array. Various attributes of the antenna array, such as beam elevation angle, beam azimuth angle, and half power beam width may be adjusted by electrical-mechanical controllers. See, for example, U.S. Pat. Nos. 6,573,875 and 6,603,436, both of which are incorporated by reference. However, the known electrically-driven phase shifters tend to suffer from complicated linkages, can typically be driven only from one end, and would require substantial engineering to adapt from one antenna design to another.

Additionally, the presence of the phase shifter assemblies in coaxial cable fed assemblies also typically means that a large number of solder joints are present. Base station antennas require many soldered joints where coaxial cable is fastened to printed circuit boards (PCBs). Many of these soldered joints involve connecting coaxial cables to phase shifter PCBs. The solder joints between coaxial cables and PCBs are susceptible to damage unless the joint is protected by a strain relief. Known strain relief structures included metal cages that guided the coaxial cables to the phase shifter PCBs. However, such strain relief was applied after the solder joint was made, thereby allowing a period of time when the solder joint was susceptible to damage.

The solder joints within the base station antennas are susceptible to damage from multiple sources. The normal movements of the cables when being dressed into their final positions during assembly can place stress on solder joints. The solder joints may be damaged during installation of the base station antenna. Solder joints may also experience damage in the field from vibration during normal operation, or as a result of weather or other external forces. Damage to the solder joint can lead to undesirable passive intermodulation (PIM) effects in the antenna transmission characteristics. Therefore, it is an object of the present invention to provide an efficient means to secure coaxial cable within base station antennas such that damage to solder joints is minimized.

The mechanical failure of solder joints in a phase shifter assembly adds to the cost of producing an antenna panel. This is especially true when the solder joint failure is not detected until after the antenna panel has been assembled. Solder joints have been known to have been mechanically compromised by simply moving a known phase shifter assembly from an assembly station to a test station.

Previous methods of coaxial cable management include use of a rigid clamp for holding the cable in the cable housing. This previous method suffers from several deficiencies. First, the diameter of common coaxial cables is subject to typical manufacturing tolerances. A rigid clamp manufactured to a specific size is often too large to secure a coaxial cable, because rigid clamps must be designed to accommodate the largest cable diameter within a given tolerance. Second, a rigid clamp does not address the problems associated with damage to solder joints due to vibration. As explained above, it is common for base station antennas to experience vibration from normal operation, or as a result of weather or other external forces. Rigid clamps do not reduce the effects of vibration of the base station antenna housing. Finally, another previous method for coaxial cable management uses a rigid clamp affixed by screws, bolts or other attachment means. For example, U.S. Pat. No. 5,411,228 to Morawa et al. discloses a cable clip having a cylindrically-shaped fastener hole for frictional engagement with the fastener device. In addition to suffering from the same deficiencies as the basic rigid clamp, the rigid clamp affixed by screws has the disadvantage of extra parts and increased cost.

SUMMARY OF THE INVENTION

The illustrative examples of the present invention provide a significant improvement over known phase shifter assemblies in terms of yield, and reliability, as well as cost of assembly, testing, and re-work. A phase shifter assembly according to one example of the present invention may be assembled, tested, and re-worked, if necessary, in its installed position on an antenna panel. In another example of the present invention, reliable assembly and testing prior to installation on the antenna panel may be achieved because the design provides for greater protection of solder joints during handling after assembly.

In one example, a phase shifter assembly is provided. The phase shifter assembly may comprise first and second sub-assemblies with certain common actuating elements. In one example, a first phase shifter sub-assembly is provided, the first phase shifter sub-assembly including a first phase shifter carrier, a first phase shifter printed circuit board mounted on the first phase shifter carrier, a first wiper printed circuit board coupled to an input of the first phase shifter printed circuit board and having at least a first end coupled to transmission lines on the first phase shifter printed circuit board, and at least one wiper support mechanically coupling the first wiper printed circuit board to the first phase shifter printed circuit board. A second phase shifter is similarly provided, the second phase shifter sub-assembly including a second phase shifter carrier, a second phase shifter printed circuit board mounted on the second phase shifter carrier, a second wiper printed circuit board coupled to an input of the second phase shifter printed circuit board and having at least one end coupled to transmission lines on the second phase shifter printed circuit board, and at least one wiper support mechanically coupling the second wiper printed circuit board to the second phase shifter printed circuit board.

Common actuating elements may include a pivot arm and a throw arm. The pivot arm may be rotatably mounted in the phase shifter assembly and be configured to engage a wiper support of at least one of the first and second phase shifter sub-assemblies. The pivot arm may further have a slot oriented substantially parallel to a longitudinal axis of the pivot arm. The throw arm may be mounted to the phase shifter assembly to allow linear movement of the throw arm, the throw arm further having a pin that engages the slot of the pivot arm such that when the throw arm is moved linearly, the pivot arm rotates around a pivot. In this way linear movement of the throw arm is translated into rotational movement of the pivot arm, resulting in rotational movement of the wiper arms.

In another example, the first and second phase shifter printed circuit boards comprise an input trace coupling an input pad to the center of the printed circuit board, and a plurality of transmission lines describing an arc having a radius extending from the pivot. The plurality of transmission lines may further comprise a first transmission line having a first radius and a second transmission line having a second radius, wherein the first radius is greater than the second radius, and wherein the arcs of the transmission line subtend substantially equal angles.

One example of a phase shifter according to the present invention locates the throw arm and pivot arm between the phase shifter sub-assemblies. In this example, the first and second wiper printed circuit boards have a first end and a second end, and are configured to pivot substantially about a middle of the wiper printed circuit board. Each wiper printed circuit board also has a wiper support at each end. The throw arm and the pivot arm may be located between the first and second phase shifter sub assemblies, and the pivot arm engages the wiper supports on the ends of the wiper printed circuit boards.

In another example, the pivot arm engages the wiper support of the first phase shifter sub assembly, and the wiper support of the first phase shifter sub assembly engages the wiper support of the second phase shifter sub assembly. In this example, the pivot arm and the throw arm may be located above the first phase shifter sub assembly.

In another example, the phase shifter assembly may include cable strain relief clamps, wherein the first and second phase shifter carriers include cable-receiving sections, including a plurality of cable recesses dimensioned to receive a cable and a plurality of recesses for receiving the cable strain relief clamps.

Generally described, the cable clamp includes a cross member and two clamp arms defining an open U-shaped body. Another aspect of the present invention relates to the shape of the clips extending from the clamp arms opposite the cross member for securing the clamp to a cable housing. A further aspect of the invention relates to a cross member having a specific geometry and composition such that the central zone of the cross member is flexible, and exerts a spring force on the coaxial cable for secure mounting into the cable housing.

Coaxial cable used in cellular communication networks is designed such that the cable diameter falls within common manufacturing tolerances. Due to the variance in diameter in all coaxial cable, known single piece cable clamps are often unable to adequately secure cable of a diameter on the narrow and possibly on the wide extreme of the cable diameter variance. Known rigid cable clamps make use of some degree of compression in the non-metallic outer jacket of known coaxial cables. However, the coaxial cables contemplated by the current invention are often generally rigid. The cables have very rigid plastic outer jackets which have effectively zero compression. To solve the problem of providing a clamp force onto varying diameter of rigid cable, the current invention incorporates a flexible portion which accommodates coaxial cable diameter variation, but still offers adequate clamping force. The cable clamp of the current invention is composed of plastic-based material having properties that allow for a flexible portion as well as a rigid clamping portion.

One advantage of the current invention is that the clamp consists of a single part to be used for securing coaxial cable. This is an improvement over known clamps that employ multiple parts, such as mounting bolts or screws, which tend to complicate installation and increase cost. Another advantage of the current invention is that the clamp engages a rigid mating part such as the cable housing, thus securing the cable between the clamp and the housing. A further advantage of the current invention is that the clamp will be removable by releasing the mounting clips manually.

DETAILED DESCRIPTION OF THE INVENTION

Figure 1:
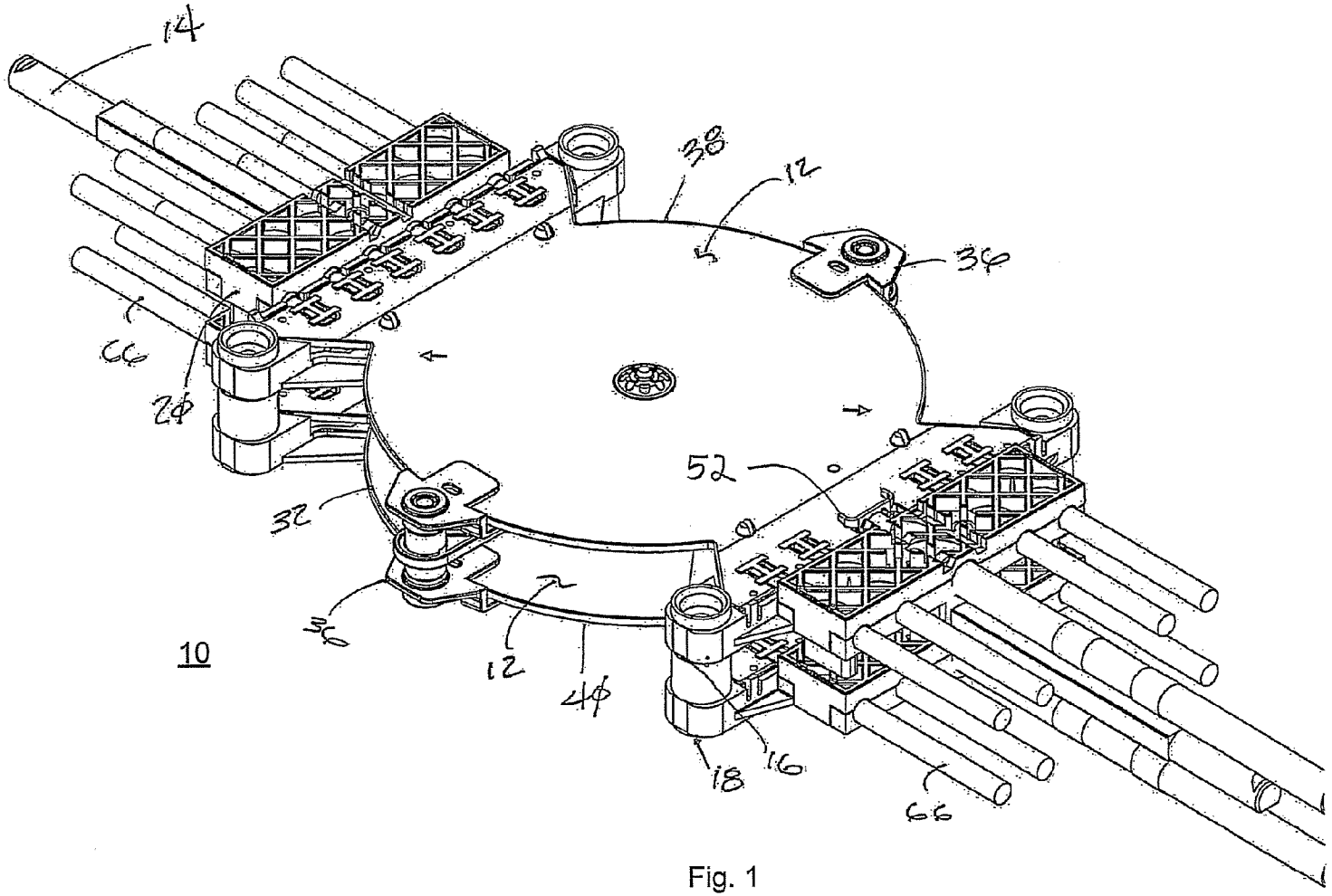
FIG. 1 is a perspective view of one example of a phase shifter assembly according to the present invention.
Figure 2:
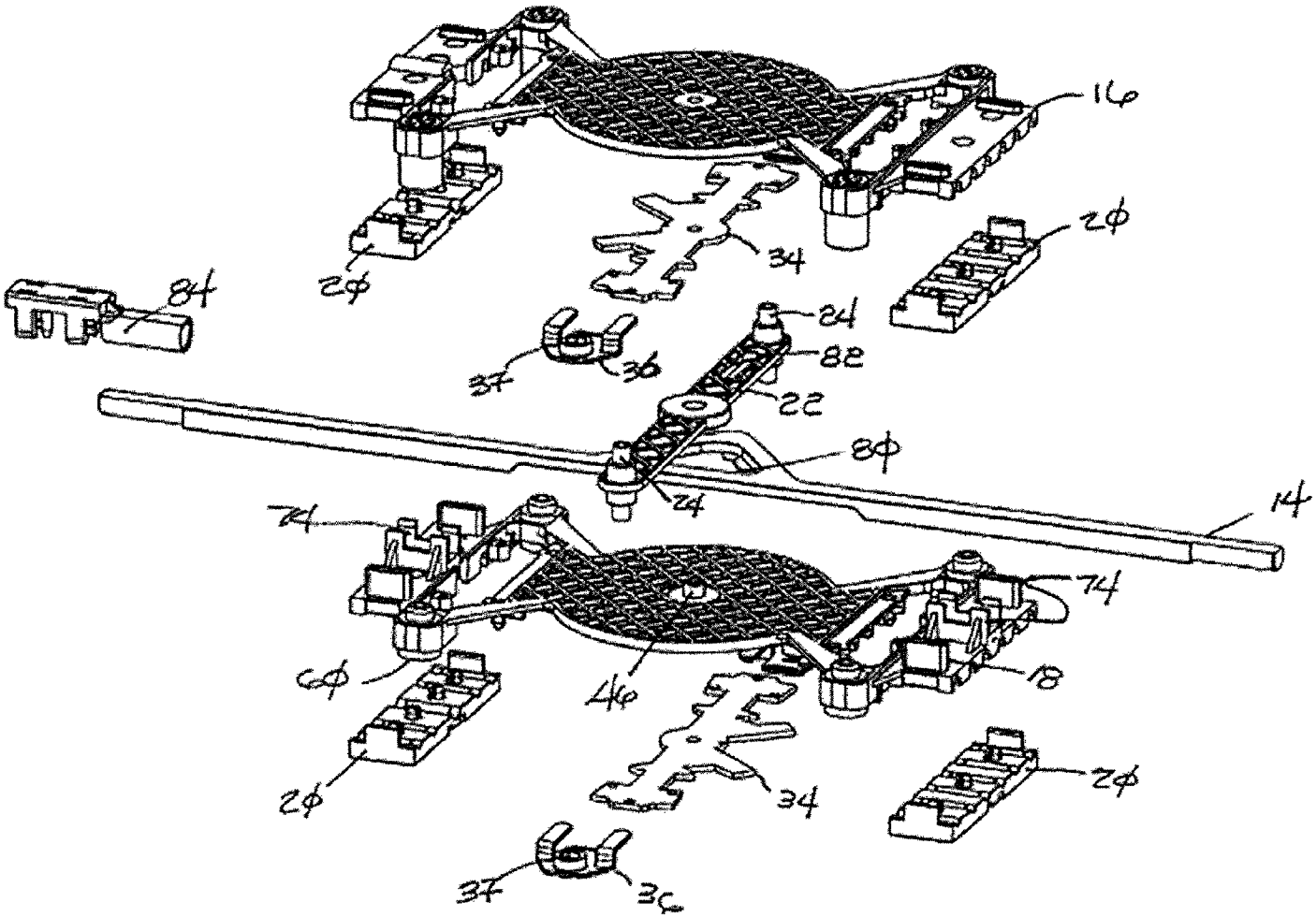
FIG. 2 is an exploded view of one example of a phase shifter assembly according to the present invention.

An improved phase shifter assembly 10 (FIG. 1), according to one example of the present invention, includes one or more phase shifter sub-assemblies along with supporting structure and actuating components. In an illustrated example, a phase shifter assembly 10 includes a plurality of phase shifters 12 (FIG. 1), actuated by a common throw arm 14 (FIG. 1, FIG. 2). In that example, support structures and actuating components of the phase shifter assembly 10 includes a top phase shifter carrier 16 (FIG. 1, FIG. 2), a bottom phase shifter carrier 18 (FIG. 1, FIG. 2), cable strain relief clamps 20 (FIG. 1, FIG. 2), a pivot arm 22 (FIG. 2), and the throw arm 14 (FIG. 2). Reference labels in the different drawing figures denote the same feature and may not be described in detail in every drawing figure in which they appear.

Figure 3:
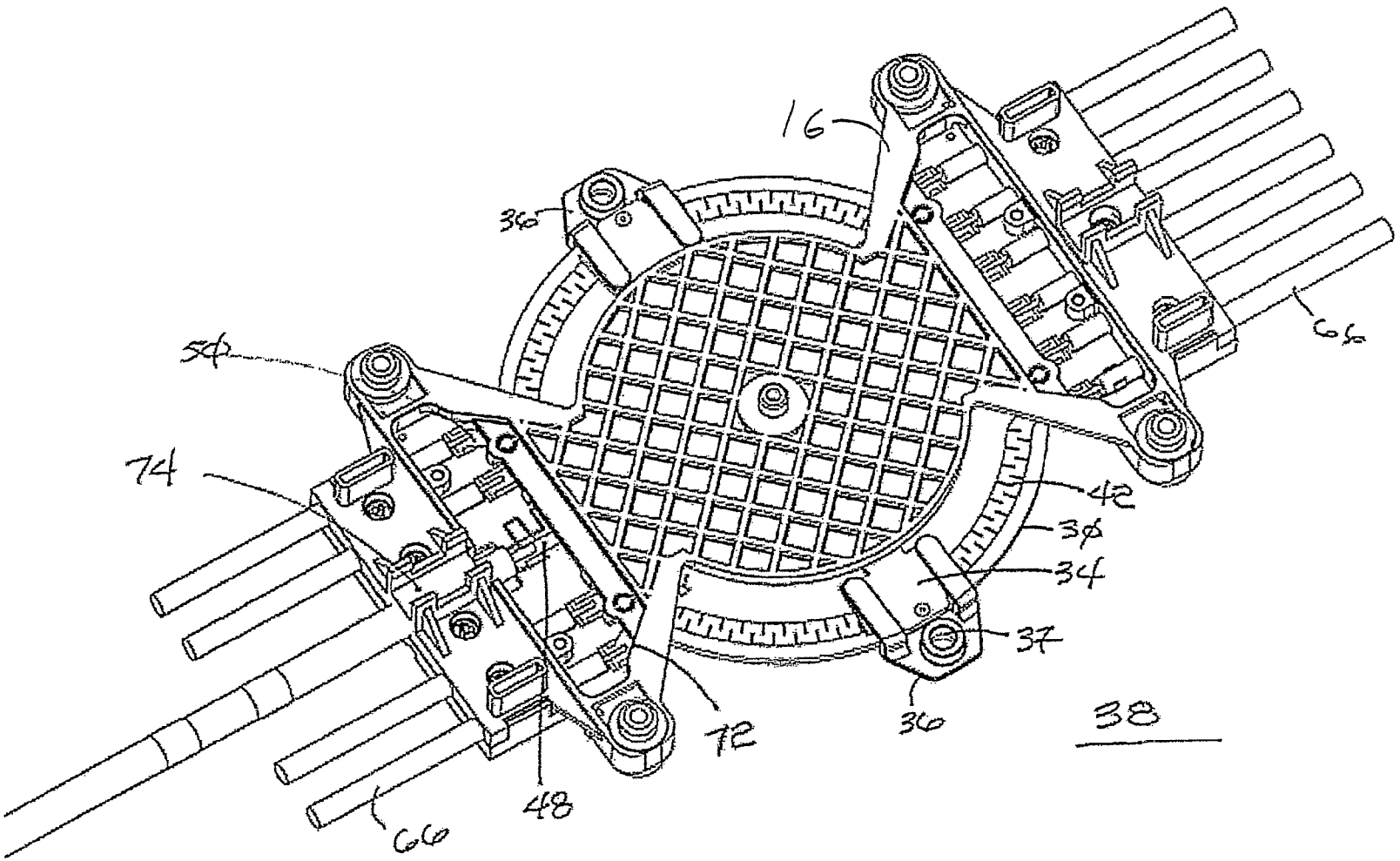
FIG. 3 is a perspective view of one example of a phase shifter sub-assembly according to the present invention.
Figure 4A:
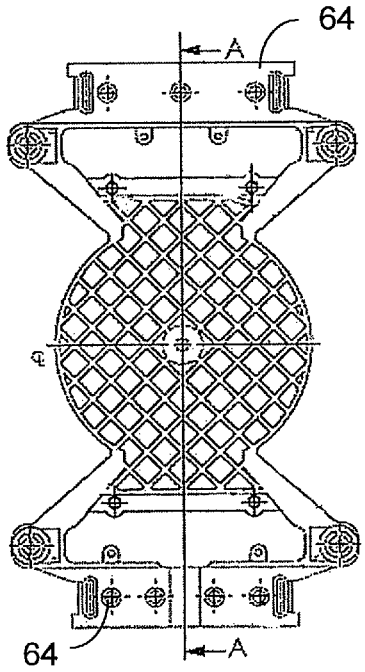
FIG. 4*a* and FIG. 4*b* are top and bottom views of a phase shifter carrier according to one example of the present invention.
Figure 4B:
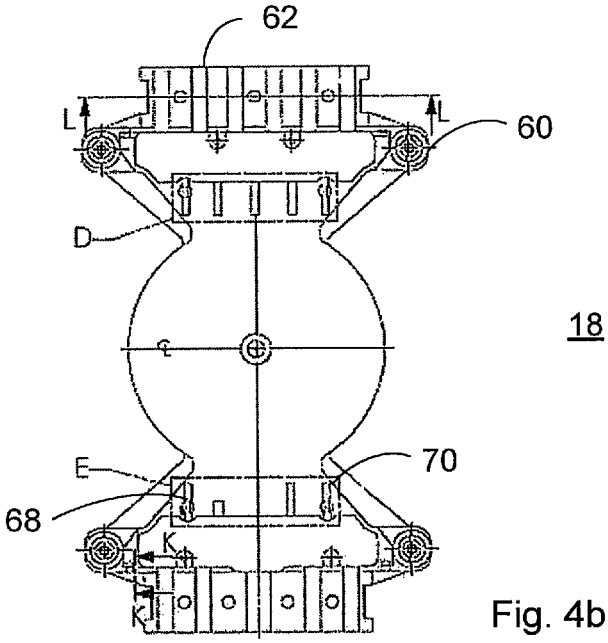

Referring to FIG. 1, FIG. 2 and FIG. 3, the phase shifters 12 (FIG. 1), in one illustrated example, are implemented on a first printed circuit board (PCB) 30 (FIG. 3), a second printed circuit board 32 (FIG. 1), wiper printed circuit boards 34 (FIG. 2, FIG. 3) and wiper supports 36. Other phase shifter structures may be implemented without departing from the present invention. The above components may be arranged so that the first PCB 30, a wiper printed circuit board 34 and two wiper supports 36 comprise a top phase shifter sub-assembly 38 (FIG. 1, FIG. 3) and the second PCB 32, a wiper printed circuit board 34 and two wiper supports 36 comprise a bottom phase shifter sub-assembly 40 (FIG. 1). In one example, the top phase shifter sub-assembly 38 may also include a top phase shifter carrier 16. The bottom phase shifter sub-assembly 40 may include a bottom phase shifter carrier 18 (FIGS. 4*a*, 4*b*).

In one example, the top phase shifter sub-assembly 38 and the bottom phase shifter sub-assembly 40 are actuated by a common pivot arm 22 (FIG. 2). In this example, the pivot arm 22 is connected to and actuates the wiper PCBs 34 (FIG. 2) by way of the wiper supports 36 (FIG. 2). The wiper PCBs 34 are electrically coupled to one or more transmission line traces 42 (FIG. 3) on the first PCB 30 (FIG. 3), and second PCB 32 (FIG. 1). The coupling may be capacitive or by direct contact. The transmission line traces 42 may be disposed in a serpentine pattern to achieve a longer effective length. In one example, there are four transmission line traces 42 on each of the first and second PCBs 30, 32, two transmission line traces 42 being disposed along an outer circumference of a PCB 30, 32, and two transmission line traces 42 being disposed on a shorter radius concentrically within the outer transmission line traces 42.

Referring to FIG. 2, the pivot arm 22 is located so that it pivots in the middle around pivot 46. Each wiper PCB 34 is provided with two wiper supports 36, which may couple the wiper PCB to the PCB 30, 32 and may further couple the ends of the pivot arm 22 to the ends of the wiper PCB 34. In one embodiment, the pivot arm 22 includes posts 24 that extend from the ends of the pivot arm 22 and each wiper support 36 includes an aperture 37 dimensioned to receive a post 24. Also, the wiper supports may couple to one of the first and second PCBs 30, 32. The wiper PCB 34 couples to two transmission lines 42 (FIG. 3) on one side of the pivot, and two additional wipers engage the outer two transmission line traces on the other side of the pivot 46.

The first and second PCBs 30, 32 may be of similar construction. Referring to FIG. 3, PCB 30 may include one or more input traces leading from an input pad 48 near an edge of the PCB 30 to where the pivot 46 (FIG. 2) and center of the wiper PCBs 34 are located. Electrical signals on an input trace are coupled to the wiper PCB 34. The wiper PCBs 34 couple the electrical signals to the transmission line traces 42. Each transmission line trace 42 is coupled to two output pads 50, one on either side of the transmission line trace 42. As the pivot arm 22 (FIG. 2) moves, an electrical length from the wiper PCB 34 to each output pad 50 changes. For example, as the pivot arm 22 moves the wiper PCB 34 to shorten the electrical length from an end of the wiper PCB 34 to one output pad 50, the electrical length from the end of the wiper PCB 34 to the other output pad 50 associated with the transmission line 42 trace increases by a corresponding amount. The first and second PCBs 30 (FIG. 1), 32 may also include soldered cable clips 52 (FIG. 1) on the input pads 48 and output pads 50 to provide for cable terminations.

Referring to FIGS. 4*a* and 4*b*, the bottom phase shifter carrier 18 may be formed of thermal conductive resin to dissipate heat, thereby increasing the power handling capacity of the phase shifter assembly 10. The bottom phase shifter carrier 18 may include mounting points 60 (FIG. 4*b*) for mounting the phase shifter assembly 10 to a reflector tray of an antenna (not shown). The other side of these mounting points 60 may include structure for mounting of the top phase shifter carrier 16. The bottom phase shifter carrier 18 also contains a cable strain relief structure including cable guides 62 (FIG. 4*b*) and clamp mounting points 64 (FIG. 4*a*) for a strain relief clamp 20 (FIG. 1, FIG. 3). The cable guides 62 of the cable strain relief structure are sized to accept coaxial cables 66 (FIG. 1, FIG. 3) and hold them securely in place once the strain relief clamps 20 are installed. The bottom phase shifter carrier 18 may also include PCB mounting points 68 (FIG. 4*b*) for the second PCB 32, which may be of a snap-fit design.

The bottom phase shifter carrier 18 further includes standoffs 70 to allow the second PCB 32 to be supported above a plane of the bottom phase shifter carrier 18. The cable strain relief structure may include a window 72 (FIG. 3) to allow for soldering of cable conductors to the input and output pads, 48, 50 after the strain relief clamp 20 and PCB 30, 32 are installed.

Figure 5:
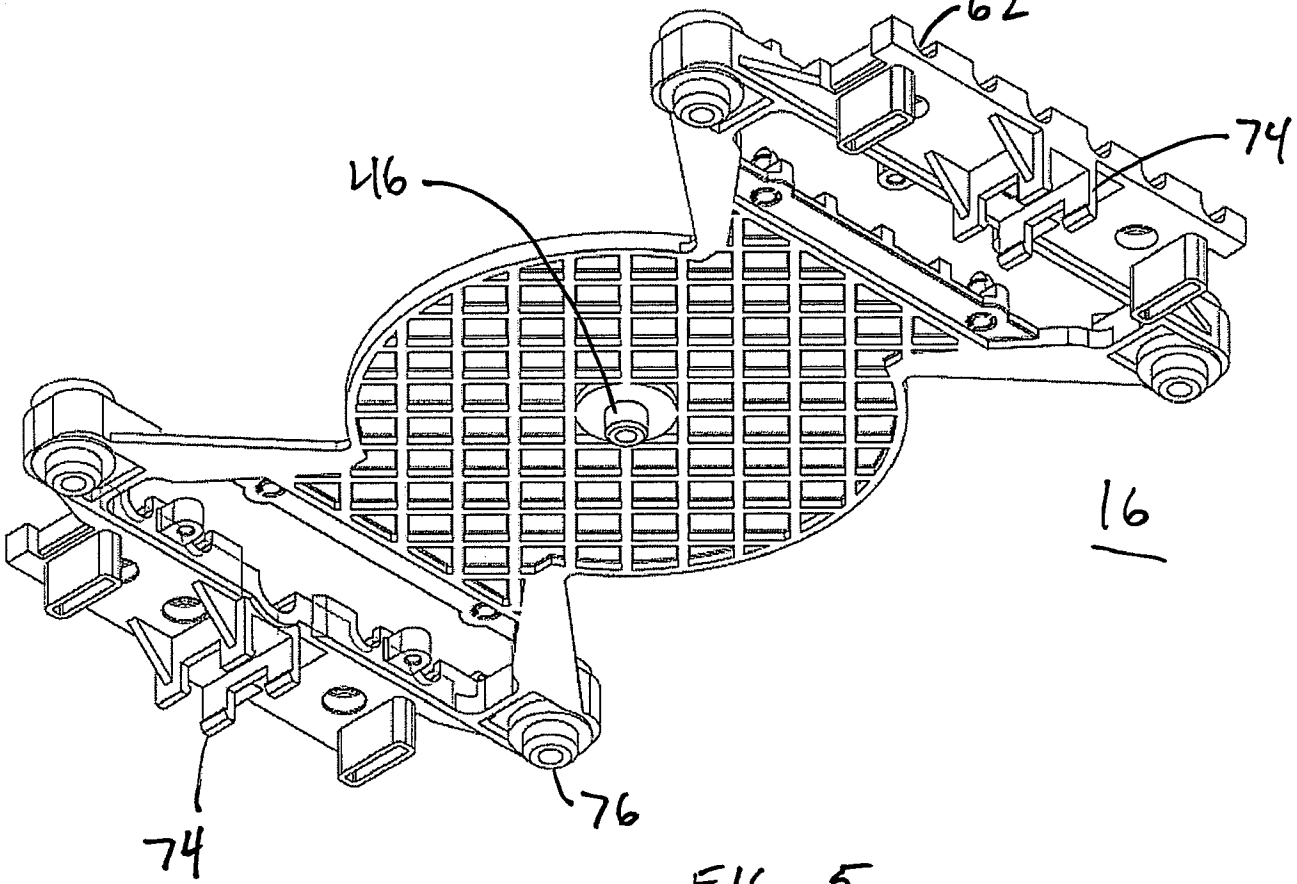
FIG. 5 is a perspective view of another example of a phase shifter carrier according to one example of the present invention.

Referring to FIG. 5, the top phase shifter carrier 16 has many features similar to the bottom phase shifter carrier 18. The top phase shifter carrier 16 also includes the pivot 46 for the pivot aim 22 (FIG. 2), and guides 74 for the throw arm 14 (FIG. 2). The top phase shifter carrier 16 also includes mount points 76 for mounting to the bottom phase shifter carrier 18.

The phase shifter assembly 10 may be assembled by preparing phase shifter sub-assemblies 38, 40, and then joining the sub-assemblies 38, 40. Phase shifter sub-assembly 38 may be prepared by assembling a wiper PCB 34 with wiper support clips 36 on the first phase shifter PCB 30. The phase shifter PCB 30 is then fit onto top phase shifter carrier 16. Coaxial cables 66 are installed and aligned to strain relief sections on the top phase shifter carrier 16. A strain relief clamp 20 is then installed, which physically secures the cables in place. The top phase shifter carrier 16 may be turned over to provide access to the conductors, and the conductors soldered onto the input and output pads. An advantage of the present invention is that the soldering operation may be performed after the strain relief has been applied. This enhances the overall reliability of the phase shifter assembly 10, because there is lower risk of damaging the solder joint by subsequent handling of the phase shifter assembly 10. Phase shifter sub-assembly 40 may be assembled in a similar fashion. The phase shifter sub-assemblies 38, 40 may be assembled in either order or at the same time. The phase shifter sub-assemblies 38, 40 may be tested individually before being assembled into the phase shifter assembly 10. For example, the bottom phase shifter sub-assembly 40 may be assembled and tested before the top phase shifter sub-assembly 38 is assembled. This results in less repair/rework of the phase shifter assemblies 10 because a defective bottom phase shifter sub-assembly 40 can be corrected before the top phase shifter sub-assembly 38 is built.

The pivot arm 22 is installed on the pivot 46 and the wiper supports are attached to the ends of the pivot arm 22. This allows the pivot arm 22 to move the wiper PCBs, even though the wiper PCB's are not mounted on the pivot arm 22. The throw arm 14 is installed in the guides and coupled to the pivot arm 22.

The phase shifter assembly 10 may be assembled, as described above, directly onto a panel antenna. Assembly directly onto a panel antenna reduces the potential for damage to the phase shifters and solder joints because there is less handling and movement of the assembly. This improves manufacturing yields and reduces costs. Additionally, testing may be performed as each phase shifter sub-assembly is completed. This reduces re-work costs because flaws in a bottom phase shifter sub-assembly may be detected and corrected before a top phase shifter sub-assembly is installed.

In one example of the invention, the throw arm 14 moves linearly, and the pivot arm 22 rotates around pivot 46. To accomplish the translation of the linear movement to rotational movement, a drive point 80 (FIG. 6) is located on the throw arm 14. A slot 82 (FIG. 2) is provided on the pivot arm 22. The drive point 80 of the throw arm 14 is located into the slot 82 of the pivot arm 22. As the throw arm 14 moves back and forth, the pivot arm 22 rotates, and the drive point 80 moves within the slot 82 of the pivot arm 22.

Figure 6:
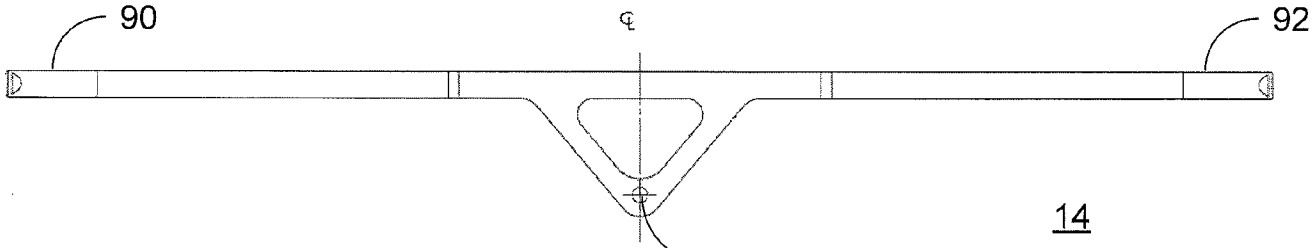
FIG. 6 is a plan view of a throw arm according to one example of the present invention.
Figure 7:
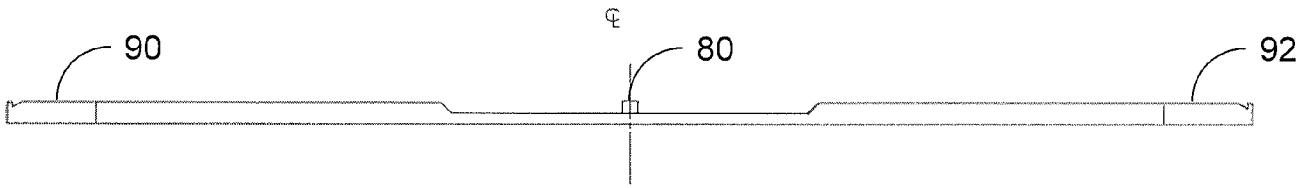
FIG. 7 is a side view of a throw arm according to one example of the present invention.

Referring to FIGS. 6-7, throw arm 14 may include the drive point 80, first end 90, and second end 92. Drive point 80 may be offset from an axis of throw arm 14 by, for example, triangular structure 96. First and second ends 90, 92, may be substantially the same, and triangular structure 96 may be located midway between ends 90, 92.

Figure 8:
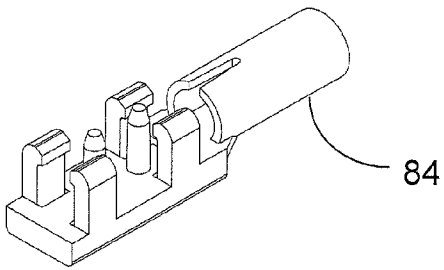
FIG. 8 is a perspective view of a linkage adapter according to one example of the present invention.

In another example, the throw arm 14 is configured to include a removable linkage adapter 84 (FIG. 8). The linkage adapter 84 may be configured to accept a manual phase adjuster linkage, an internal electrical actuator, an external electrical actuator, or other known linear actuators. In this regard, the throw arm 14, pivot arm 22 and linkage adapter 84 provide an improvement over known phase shifter by eliminating the need for custom linkages. The throw arm linkage provided above may be used over a wide variety of phase shifters, and with virtually any linear actuators without having to design custom linkages. Additionally, in the illustrated example, linkage adapter 84 may be fitted to either the first end 90 or the second end 92 of throw arm 14, allowing throw arm 14 to be actuated from either side of the phase shifter assembly 10.

In a final step of assembly, the top phase shifter carrier 16 is attached to the bottom phase shifter carrier 18. At this point, the pivot arm 22 is connected to the wiper supports on the wiper PCBs of both phase shifters PCBs 30, 32.

Optionally, the first PCB 30 and the second PCB 32 may be grounded together with tin plated copper rods.

Another improvement over the art is the separation of the wiper PCBs from the pivot arm 22. In the illustrated examples, the wiper PCBs may be customized to any particular phase shifter requirements without retooling pivot arm 22 because the wiper PCBs are coupled to the wiper arm only by the wiper supports. Thus, wide application of the throw arm 14 and pivot arm 22 may be had without extensive redesign of any new linkages.

Figure 9:
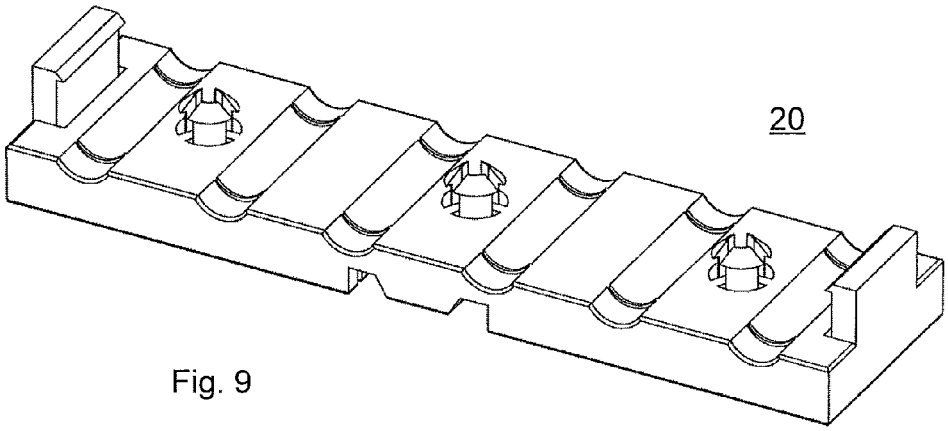
FIGS. 9 and 10 are perspective views of cable strain relief clamps according to one example of the present invention.
Figure 10:
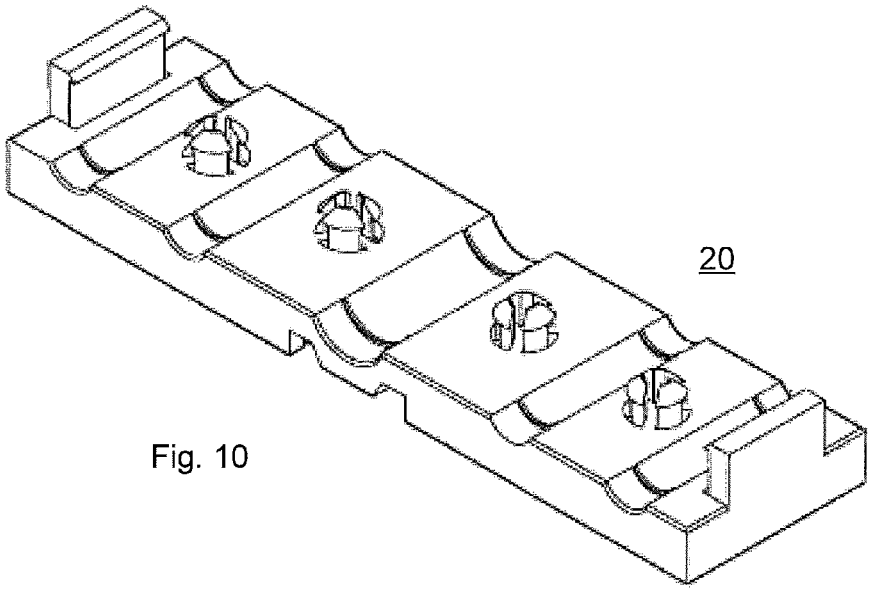
Figure 11:
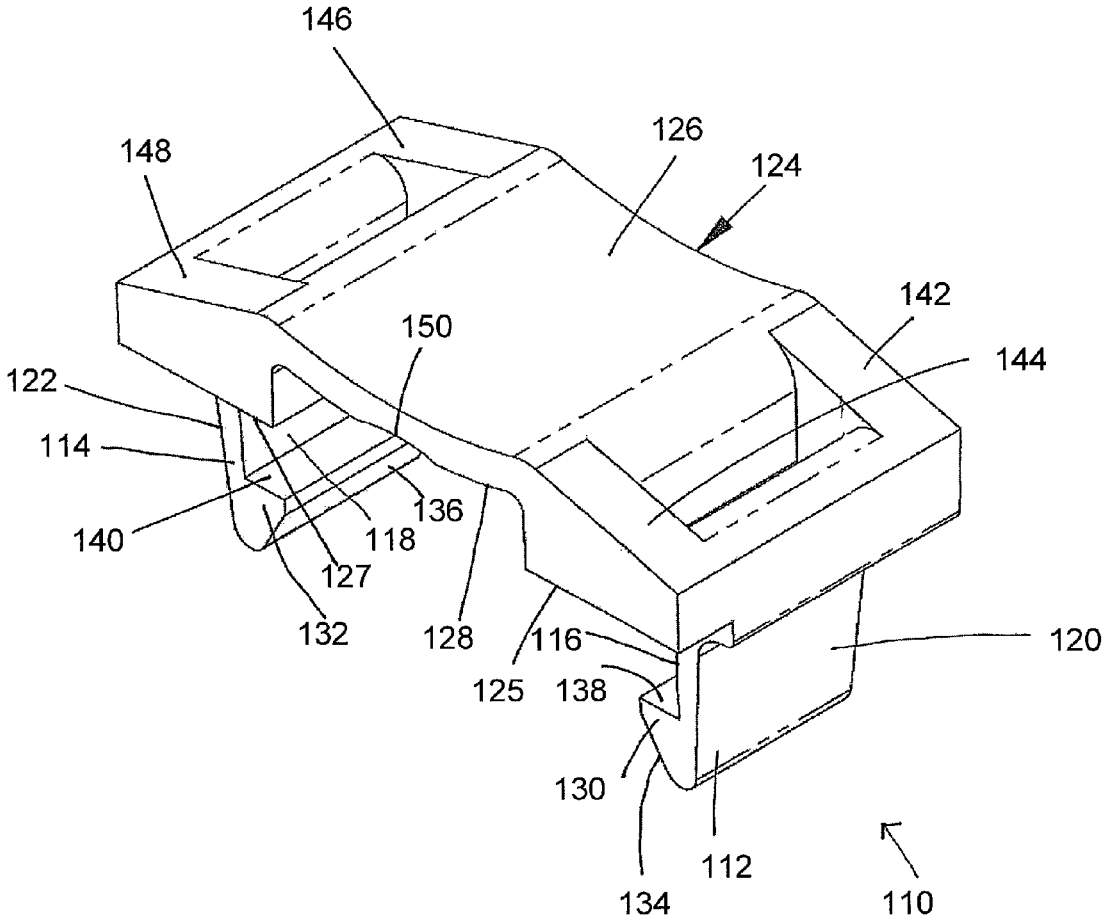
FIG. 11 is a perspective view of a cable strain relief clamp according to an alternate example of the present invention.
Figure 12:
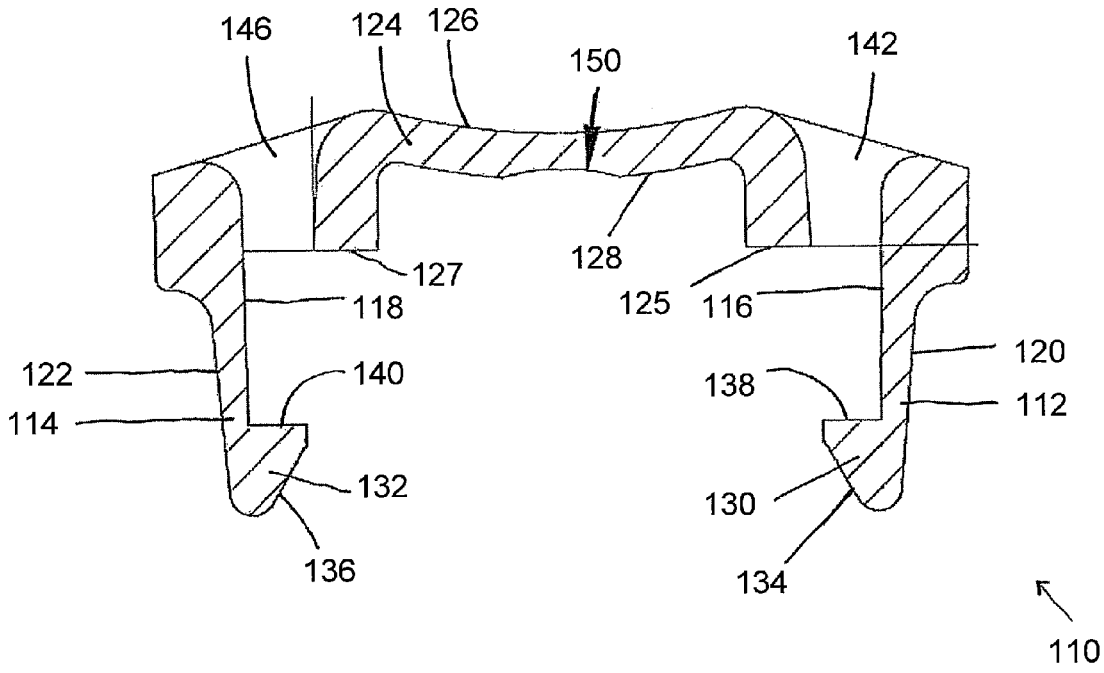
FIG. 12 is a cut-away view of a cable strain relief clamp according to an alternate example of the present invention.
Figure 13:
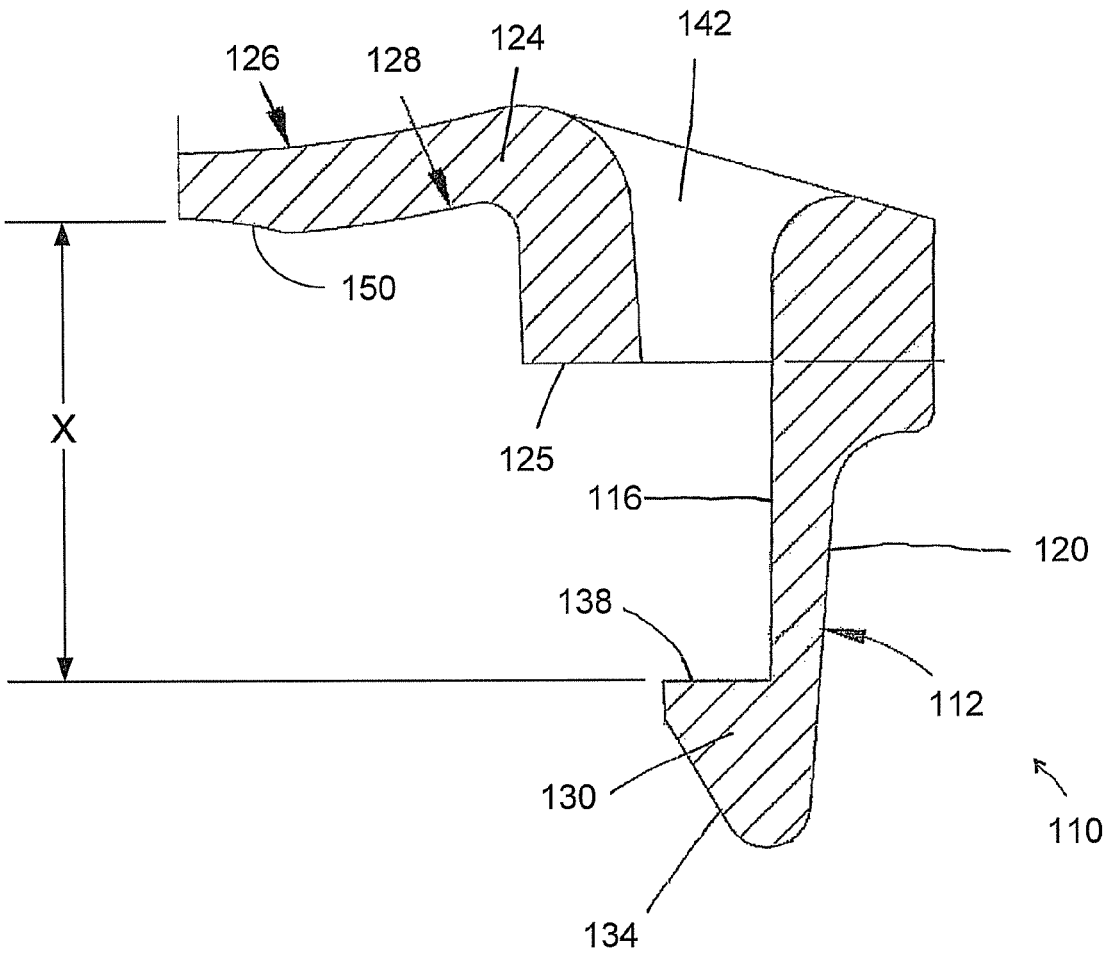
FIG. 13 is a cut-away view of a cable strain relief clamp according to an alternate example of the present invention.
Figure 14:
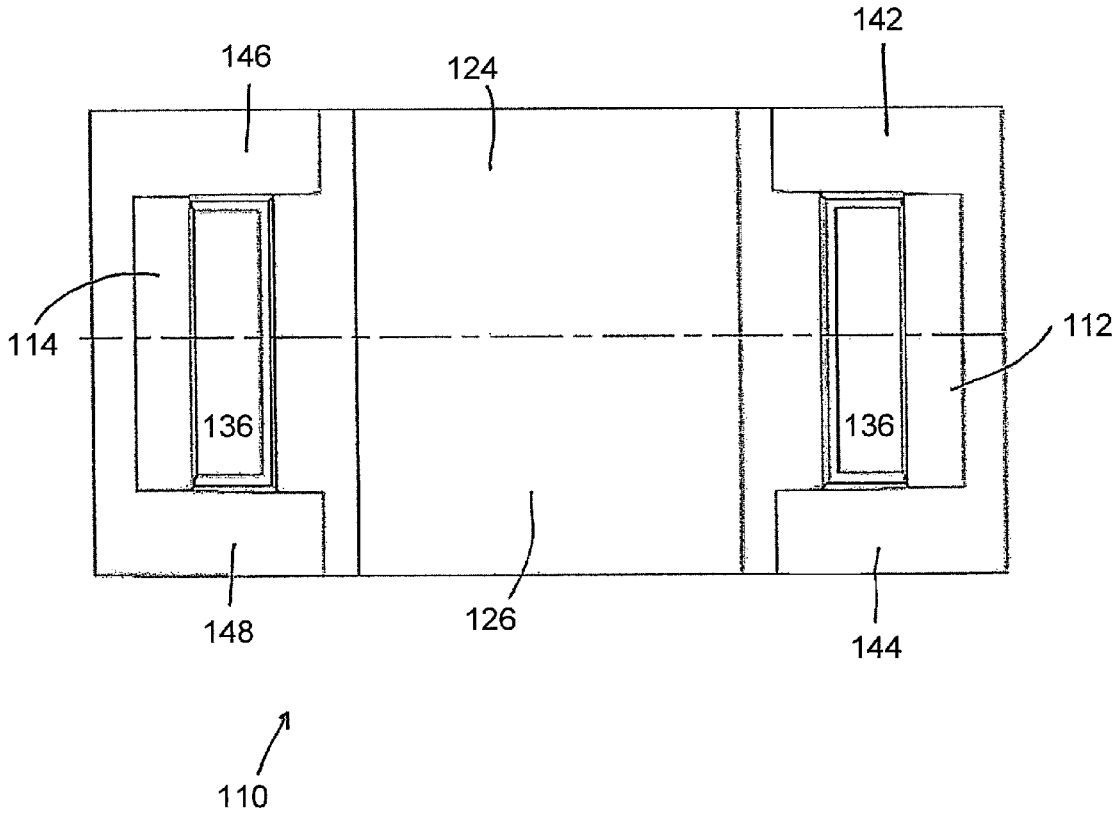
FIG. 14 is a plan view of a cable strain relief clamp according to an alternate example of the present invention.

Alternate embodiments may include alternate cable strain relief structures. In the examples illustrated in FIGS. 1-2, strain relief clamps 20, such as illustrated in FIGS. 9, 10 may be used. Referring now to FIG. 11, an improved cable clamp 110 for managing coaxial cables is shown. Reference labels in the different drawing figures denote the same feature and may not be described in every drawing figure in which they appear. Clamp 110 can be used in a variety of structures, including a base station antenna assembly for cellular communication systems. Clamp 110 is a single-body structure formed by plastic-based injection-molding techniques that are well known in the art. Clamp 110 includes two clamp arms 112 and 114, which have inner faces 116 and 118, respectively, and outer faces 120 and 122, respectively. A cross member 124 extends between the two clamp arms 112 and 114. Cross member 124 has a top face 126, contact surfaces 125 and 127, and bottom face 128. Clamp arms 112 and 114 have retaining tabs 130 and 132 mounted at the inner ends of the clamp arms. Retaining tabs 130 and 132 extend partially across a roughly U-shaped region defined by the cross member 124 and clamp arms 112 and 114. Retaining tabs 130 and 132 are designed to fit around the cable housing within base station antenna assemblies. Referring to FIG. 13, tab 130 includes an angled face 134 and a locking notch 138, which is spaced apart from bottom face 128 by a distance X. Referring to FIG. 12, Tab 132, angled face 136, and locking notch 140 are similarly configured. Distance X (FIG. 13) is based on the thickness of the cable housing onto which clamp 110 will be affixed. Thicker cable housing will require a larger distance X. A top view of clamp 110 is found in FIG. 14.

A coaxial cable fitted within a cable housing can be secured in place by affixing clamp 110 to the cable housing, thereby holding the cable in place between cable housing and the bottom face 128 of cross member 124. Bottom face 128 may further include a curved area 150 to aid in cable retention. When retaining tabs 130 and 132 are pressed against the cable housing, angled faces 134 and 136 press against the edges of the cable housing and force clamp arms 112 and 114 outward. As the clamp is pressed against the cable housing, the clamp arms will continue to be forced outward until the retaining tabs 130 and 132 pass beyond the cable housing. Once the retaining tabs 130 and 132 pass beyond the cable housing, the clamp arms 112 and 114 return to their original orientation and retaining tabs 130 and 132 engage the far side of the cable housing to hold the clamp in place. Retaining tabs 130 and 132, inner faces 116 and 118, and contact surfaces 125 and 127 are in contact with the cable housing cooperate to secure the clip to the housing. Once retaining tabs 130 and 132 have engaged the far side of the cable housing, and upward force on the cable will cause the clamp to grip the housing tighter.

Referring now to FIG. 12, the details of the cross member 124 are shown. Clamp arms 112 and 114 connectively couple with the cross member 124 with support members 142, 144. Clamp arms 112 and 114 also connectively couple with the cross member 124 with support members 146 and 148 (FIG. 11, FIG. 14), however because FIG. 12 is cross-section of clamp 110, support members 144, 148 are not illustrated in FIG. 12. Cross member 124 engages the coaxial cable and provides the necessary force to retain the cable in the cable housing. Once engaged with the cable housing, the cross member 124 exhibits a spring force upon the coaxial cable. In one example of the present invention, the cross member 124 is a resilient, deformable structure. In this example, cross member 124 derives its flexibility from a combination of resilient materials (described below), geometry and thickness. Cross member 124 may employ a slight concave curvature relative to the clamp arms. Cross member 124 may also have a slight cable cutout guide 150 for ensuring a secure engagement with the coaxial cable. In other examples, flat or V-shapes may be employed. During the installation of the clamp 110, cross member 124 is free to flex as the clamp 110 is forced over the cable and the clamp arms 112 and 114 engage the cable housing. In other words, the coaxial cable forces the concave cross member 124 slightly outward. This slight flexion provides the necessary spring force to retain the coaxial cable in place within the cable housing.

In another embodiment of the present invention (not separately illustrated), the clamp 110 may be formed in a two-shot molding process. In this embodiment, clamp 110, is composed of two materials having differing degrees of flexibility. A majority of clamp 110 is molded from a relatively rigid plastic material. However, a more flexible and resilient elastomeric material is molded onto cross member 124. While the clamp 110 may be less flexible, the greater flexibility and resiliency of the elastomeric material provides improved cable holding strength, especially when the clamp 110 is used to clamp a cable with a corrugated or helical metal jacket.

The clamp 110 is typically affixed near the solder joint end of a section of coaxial cable. This orientation provides optimal security against damage to the solder joint. Additional clamps may also be affixed along the length of the cable, providing additional security and cable management options. The cable clamp 110 holds the cable down with an adequate amount of force, while also not being too stiff such that it is difficult for an operator to install the clamp. In other words, the clamp arms 112 and 114 and retaining tabs 130 and 132 are stiff enough to provide secure engagement, but not so stiff as to be difficult for an installer to affix to the cable housing.

When coaxial cables are soldered onto the PCBs of the antenna assemblies, it is important that the cables remain stationary. A further advantage of the current invention is that the clamp anchors the cable before the soldering process. The cable clamp eliminates any upwards cable movement during soldering. In other words, the clamp acts as a kind of assembly jig. Once the cable has been soldered into position, the cable clamp remains as a guard against unnecessary strain on the solder joint; subsequent cable movement may occur beyond clamp, but the cable nearest the solder joint remains stationary. This method of securing the coaxial cable within the cable housing during the soldering process results in better yield in acceptable solder joints. In the preferred embodiment, the clamp should be used in conjunction with features within the PCB housing to offer the best overall protection. While the clamp is primarily designed to prevent vertical cable movement, the cable clamp can also prevent limited lateral movement of the cable close to the solder joint. The cable housing offers superior protection against unwanted lateral movement. Therefore, when used together, the cable clamp cooperating with the cable housing prevents most vertical and horizontal cable movement.

A further advantage of the current invention is that the spring force of the cross member 124 acts as a damper to vibration that can lead to solder joint damage. Rigid clamps transfer a significant amount of vibrational energy directly to the coaxial cable, which, over time, can result in damage to or failure of the terminal solder joints. The cross member of the clamp is flexible, and therefore absorbs a significant amount of vibrational energy, thereby reducing the vibrations in the cable that cause solder joint damage.

In a preferred embodiment, the cable clamp is constructed by an injection-molding process known in the art, using a plastic-based material such as high-viscosity copolymer acetal. This particular material has the desired flexibility and rigidity required by the cable clamp retaining tabs and the cross member. High-viscosity copolymer acetal exhibits qualities that allow the clamp to flex without cracking or breaking, while also providing resiliency to return to the original shape after being flexed and deformed during attachment to the cable housing. The specific geometry and construction of the cable housing within the base station antenna is not a limitation of the current invention. The cable clamp of the current invention is capable of engaging cable housings of different design and geometry. For example, the cable housing may exhibit a v-shaped channel in which the coaxial cable is retained. However, the v-shaped channel is not necessary for an effective anchor. Depending on the material used to construct the cable housing, the channel can be more rounded than v-shaped. The cable housing can be metal or plastic. The cable housing must allow the clamp arms 112 and 114 of clamp 110 to engage the housing via the retaining tabs 130 and 132.

Figure 15:
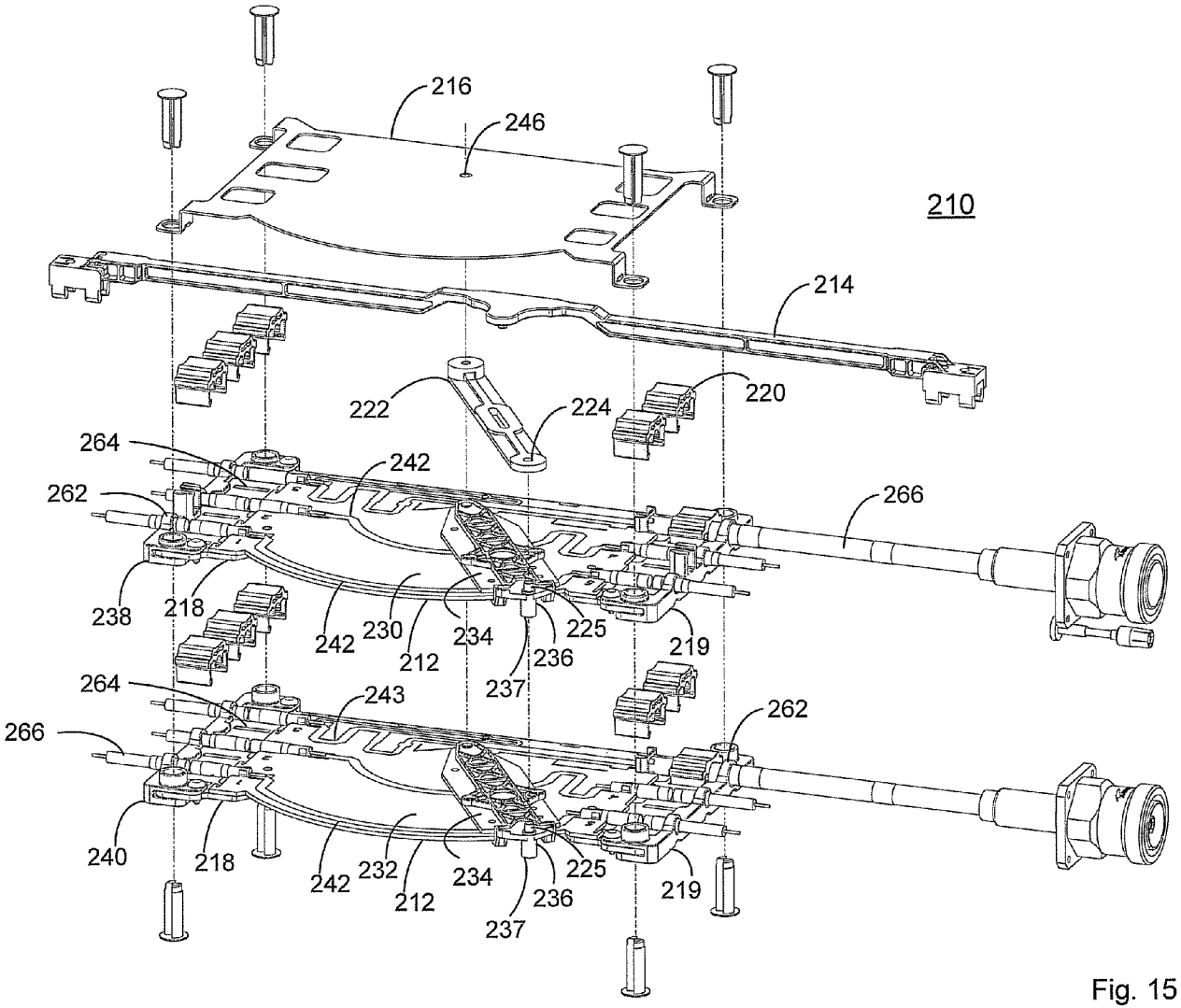
FIG. 15 is an exploded view of an example of a phase shifter assembly according to an alternate embodiment of the present invention.

Another example of the present invention is illustrated in FIG. 15. Phase shifter assembly 210, according to this example, includes one or more phase shifter sub-assemblies 238, 240 along with supporting structure and actuating components. The phase shifter assembly 210 includes a plurality of phase shifters 212 actuated by a common throw arm 214. In this example, support structures and actuating components of the phase shifter assembly 210 include shield 216, phase shifter carrier 218, end pieces 219, cable strain relief clamps 220, a pivot aim 222, and the throw arm 214.

The phase shifters 212, in this example, are implemented on a first printed circuit board (PCB) 230, a second printed circuit board 232, wiper printed circuit boards 234 and wiper supports 236. The PCBs 230, 232 may be similar to the PCBs 30, 32 of the earlier embodiment. Alternatively, as shown, the PCBs 230, 232 may comprise a 1:5 phase shifter, with only two phase shifters 212 instead of four. In this example, the wiper printed circuit board 234 may correspond to half of wiper PCB 34. Other phase shifter structures may be implemented without departing from the present invention.

The above components may be arranged so that the first PCB 230, a wiper printed circuit board 234 and a wiper supports 236 comprise a top phase shifter sub-assembly 238 and the second PCB 232, a wiper printed circuit board 234 and a wiper support 236 comprise a bottom phase shifter sub-assembly 240. In the examples illustrated in FIG. 15, the top phase shifter sub-assembly 238 and the bottom phase shifter assembly 240 may each further include phase shifter carriers 218. In this example, phase shifter carriers 218 may be stamped or cut from sheet metal. End pieces 219 may engage and support the ends of the PCBs 230, 232.

In this example, the top phase shifter sub-assembly 238 and the bottom phase shifter sub-assembly 240 are actuated by a common pivot arm 222. In this example, the pivot arm 222 is connected to and actuates the wiper PCBs 234 by way of the wiper supports 236. The pivot arm 222 is located by a pivot 246 on the shield 216. The pivot arm also engages a wiper support 236 associated with the top phase shifter sub-assembly 238. The wiper support 236 of the bottom phase shifter sub-assembly 240 engages the wiper support 236 of the top phase shifter sub-assembly 238.

The wiper PCBs 234 are electrically coupled to one or more transmission line traces 242 on the first and second PCBs 230, 232. The coupling may be capacitive or by direct contact. The transmission line traces 242 may be disposed in a serpentine pattern to achieve a longer effective length. In the example, there are two transmission line traces 242 on each of the first and second PCBs 230, 232, one transmission line trace 242 being disposed along an outer circumference of a PCB 230, 232, and one transmission line trace 242 being disposed on a shorter radius concentrically within the outer transmission line trace 242. Additionally, a transmission line trace 243 provides a non-adjustable path through the phase shifter.

In the illustrated example, the pivot arm 222 is located so that it pivots at one end around pivot 246. Each wiper PCB 234 is provided with one wiper support 236, which couples an end of the pivot arm 222 to an end of the wiper PCB 234. In one embodiment, the pivot arm 222 includes an aperture 224 and each wiper support 236 includes a post 225 and aperture 237. The post 225 is dimensioned to engage either aperture 224 or aperture 237, depending on whether the wiper support 236 is part of the top phase shifter sub-assembly 238 or the bottom phase shifter sub-assembly 240. Also, the wiper supports may couple to one of the first and second PCBs 230, 232 to hold the wiper PCB 234 in a desired relationship to the PCBs 230, 232. The wiper PCB 234 is electrically coupled to transmission lines 242.

The end pieces 219 may be formed of injected molded plastic or thermal conductive resin. The end pieces 219 may include cable guides 262. Clamp mounting points 264 for receiving strain relief clamps 220 are preferably located on the base 218, but may be on end pieces 219. The cable guides 262 are sized to accept coaxial cables 266. Base 218 may be contoured to accept coaxial cables 266.

Figure 16A:
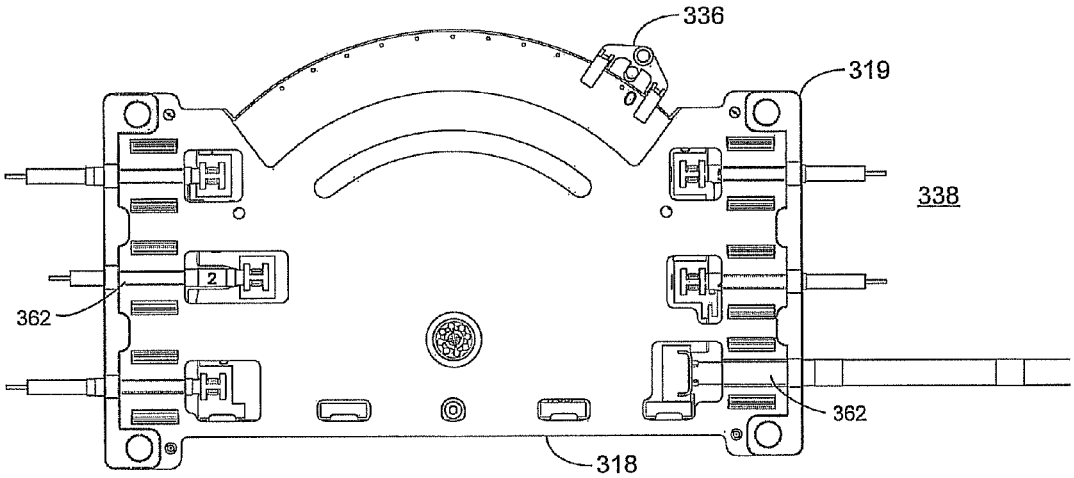
FIG. 16*a* is a plan view of an example of a phase shifter assembly according to another alternate embodiment of the present invention.
Figure 16B:
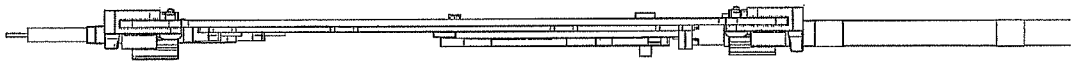
FIG. 16*b* is a side view of an example of a phase shifter assembly according to another alternate embodiment of the present invention.
Figure 16C:
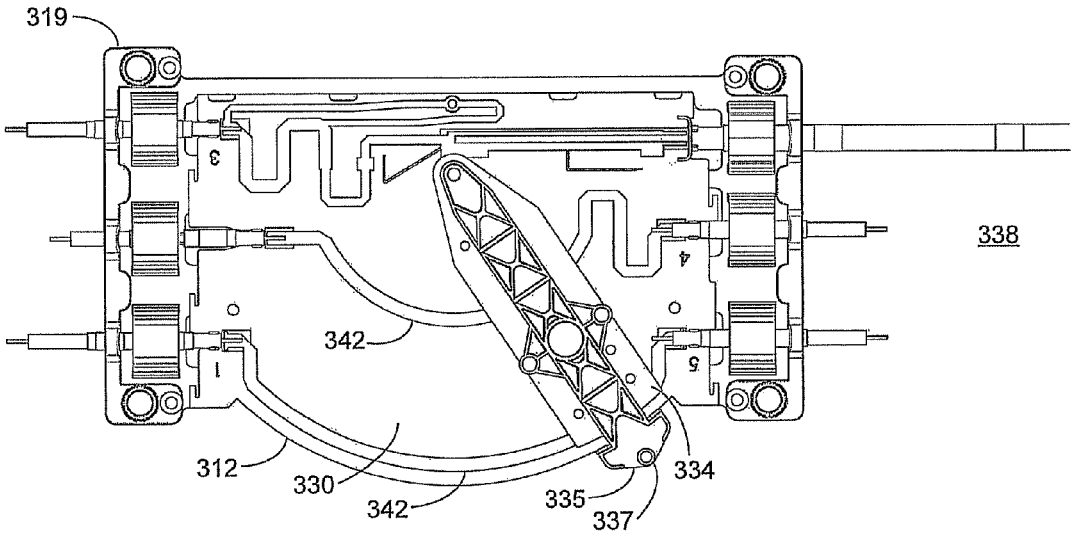
FIG. 16*c* is a bottom view of an example of a phase shifter assembly according to another alternate embodiment of the present invention.
Figure 17:
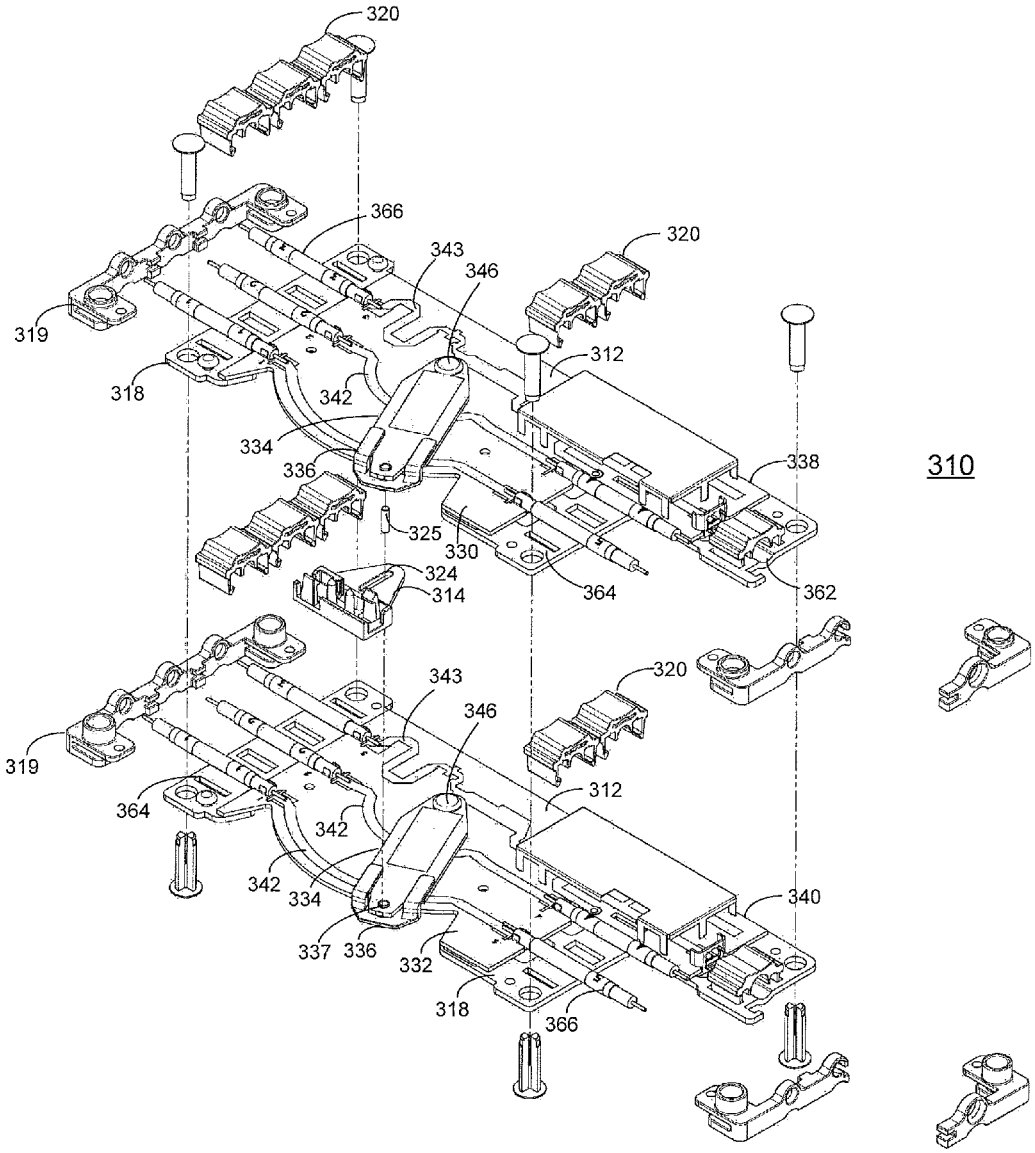
FIG. 17 is an exploded view of example of a phase shifter assembly according to another alternate embodiment of the present invention.

Alternate examples of the present invention are illustrated in FIGS. 16*a*-16*c* and 17. Phase shifter assembly 310 (FIG. 17), according to these examples, includes one or more phase shifter sub-assemblies 338 (FIGS. 16*a*-16*c*, FIG. 17), 340 (FIG. 17) along with supporting structure and actuating components. Referring to FIG. 17, the phase shifter assembly 310 includes a plurality of phase shifters 312 actuated by a common cleat assembly 314. In this example, support structures and actuating components of the phase shifter assembly 310 may include phase shifter carriers 318, end pieces 319, cable strain relief clamps 320, and the cleat assembly 314.

The phase shifters 312, in this example, are implemented on a first printed circuit board (PCB) 330, a second printed circuit board 332 (FIG. 17), and wiper printed circuit boards 334. In the example of FIG. 16*c*, pivot arm 335 includes an integrated wiper support. The PCBs 330, 332 may be similar to the PCBs 30, 32 of the earlier embodiment. Alternatively, as shown, the PCBs 330, 332 may comprise a 1:5 phase shifter, with only two phase shifters 312 instead of four. In this example, the wiper printed circuit board 334 may correspond to half of wiper PCB 34. Other phase shifter structures may be implemented without departing from the present invention.

The above components may be arranged so that the first PCB 330, a wiper printed circuit board 334 and a wiper support 336 comprise a top phase shifter sub-assembly 338 and the second PCB 332, a wiper printed circuit board 334 and a wiper support 336 comprise a bottom phase shifter sub-assembly 340 (FIG. 17). In the illustrated example, the top phase shifter sub-assembly 338 and the bottom phase shifter assembly 340 may each further include phase shifter carriers 318. In this example, phase shifter carriers 318 may be stamped or cut from sheet metal. The phase shifter carriers 318 may include cable guides 362 (FIG. 16*a*, FIG. 17). End pieces 319 may engage and support the ends of the PCBs 330, 332.

In this example, the top phase shifter sub-assembly 338 and the bottom phase shifter sub-assembly 340 are actuated by a common cleat assembly 314. In this example, the cleat assembly 314 is connected to and actuates the wiper PCBs 334 by way of the wiper supports 336. The cleat assembly 314 engages a wiper support 336 associated with the top phase shifter sub-assembly 338. The wiper support 336 of the bottom phase shifter sub-assembly 340 also engages the cleat assembly 314, such that the cleat assembly 314 is disposed between the wiper supports of the top and bottom phase shifter sub-assemblies.

The wiper PCBs 334 are electrically coupled to one or more transmission line traces 342 (FIG. 16*b*, FIG. 17) on the first and second PCBs 330, 332. The coupling may be capacitive or by direct contact. The transmission line traces 342 may be disposed in a serpentine pattern to achieve a longer effective length. The illustrated example has two transmission line traces 342 on each of the first and second PCBs 330, 332, one transmission line trace 342 being disposed along an outer circumference of a PCB 330, 332, and one transmission line trace 342 being disposed on a shorter radius concentrically within the outer transmission line trace 342. Additionally, a transmission line trace 343 provides a non-adjustable path through the phase shifter.

In the illustrated example of FIG. 17, the cleat assembly 314 is located so that it engages at one end around an actuating arm (not shown). Each wiper PCB 334 is provided with one wiper support 336, which couples an end of the cleat assembly 314 to an end of the wiper PCB 334. The end of the wiper support 336 distal to the cleat assembly 314 is affixed to the PCBs 330, 332 at pivot 346. In one embodiment, the cleat assembly 314 includes a slot 324 and each wiper support 336 includes an aperture 337. A guide pin 325 is dimensioned to be inserted through slot 324 and to engage apertures 337 of each wiper support 336. Also, the wiper supports may couple to one of the first and second PCBs 330, 332 to hold the wiper PCB 334 in a desired relationship to the PCBs 330, 332. The wiper PCB 334 is electrically coupled to transmission lines 342.

In one example of the invention, the actuating arm (not shown) moves linearly, and each wiper support 336 rotates around pivot 346. To accomplish the translation of the linear movement to rotational movement, the actuating arm is connectively coupled to the cleat assembly 314. As described above, the guide pin 325 is located into the slot 324 of the cleat assembly 314. As the actuating arm moves back and forth, the wiper support 336 rotates about pivot 346, and the guide pin 325 moves within the slot 324 of the cleat assembly 314.

The end pieces 319 may be formed of injected molded plastic or thermal conductive resin. The end pieces 319 may include cable guides 362. Clamp mounting points 364 (FIG. 17) for receiving strain relief clamps 320 are preferably located on the phase shifter carrier 318, but may be on end pieces 319. The cable guides 362 are sized to accept coaxial cables 366. Phase shifter carrier 318 may be contoured to accept coaxial cables 366 (FIG. 17).

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments and equivalents falling within the scope of the appended claims.

Various features of the invention are set forth in the following claims.

What is claimed is:

1. A phase shifter assembly, comprising:

a. a first phase shifter sub-assembly, the first phase shifter sub-assembly including a first phase shifter carrier, a first phase shifter printed circuit board mounted on the first phase shifter carrier, a first wiper printed circuit board coupled to an input of the first phase shifter printed circuit board and having at least a first end coupled to a plurality of transmission lines on the first phase shifter printed circuit board, and at least one first wiper support mechanically coupling the first wiper printed circuit board to the first phase shifter printed circuit board;

b. a second phase shifter sub-assembly, the second phase shifter sub-assembly including a second phase shifter carrier, a second phase shifter printed circuit board mounted on the second phase shifter carrier, a second wiper printed circuit board coupled to an input of the second phase shifter printed circuit board and having at least one end coupled to a plurality of transmission lines on the second phase shifter printed circuit board, and at least one second wiper support mechanically coupling the second wiper printed circuit board to the second phase shifter printed circuit board;

c. a pivot arm rotatably mounted in the phase shifter assembly and being configured to engage at least one of the first and second wiper supports, the pivot arm further having a slot oriented substantially parallel to a longitudinal axis of the pivot arm; and d. a throw arm mounted to the phase shifter assembly to allow linear movement of the throw arm, the throw arm further having a pin that engages the slot of the pivot arm such that when the throw arm is moved linearly, the pivot arm rotates around a pivot.

2. The phase shifter assembly of claim 1, further comprising cable strain relief clamps, wherein the first and second phase shifter carriers include cable-receiving sections, including a plurality of cable recesses dimensioned to receive a cable and a plurality of recesses for receiving the cable strain relief clamps.

3. The phase shifter assembly of claim 1, wherein each of the first and second phase shifter printed circuit boards further comprises an input trace coupling an input pad to the center of the printed circuit board, and wherein each of the plurality of transmission lines comprises at least one transmission line that describes an arc having a radius extending from the pivot.

4. The phase shifter assembly of claim 3, wherein each of the plurality of transmission lines further comprises a first transmission line having a first radius and a second transmission line having a second radius, wherein the first radius is greater than the second radius.

5. The phase shifter assembly of claim 1, wherein:

the first wiper printed circuit board comprises a first end and a second end, and is configured to pivot substantially about a middle of the first wiper printed circuit board, the at least one first wiper support further comprising first and third wiper supports, the first wiper support mechanically coupling the first end of the first wiper printed circuit board to the first phase shifter printed circuit board and the third wiper support mechanically coupling the second end of the first wiper printed circuit board to the first phase shifter printed circuit board, and the second wiper printed circuit board comprises a first end and a second end, and is configured to pivot substantially about a middle of the second wiper printed circuit board, the at least one second wiper support further comprising second and fourth wiper supports, the second wiper support mechanically coupling the first end of the second wiper printed circuit board to the second phase shifter printed circuit board and the fourth wiper support mechanically coupling the second end of the second wiper printed circuit board to the second phase shifter printed circuit board.

6. The phase shifter assembly of claim 5, wherein the throw arm and the pivot arm are located between the first and second phase shifter sub assemblies, and the pivot arm engages the first, second, third, and fourth wiper supports.

7. The phase shifter assembly of claim 1, wherein the pivot arm engages the at least one first wiper support of the first phase shifter sub-assembly, and the at least one first wiper support of the first phase shifter sub assembly engages the at least one second wiper support of the second phase shifter sub-assembly.

8. The phase shifter assembly of claim 7, wherein the pivot arm and the throw arm are located above the first phase shifter sub-assembly.

9. The phase shifter assembly of claim 1, wherein the throw arm further comprises a first end and a second end, and wherein the first and second ends are configured to receive a linkage adapter.

10. A cable strain relief clamp comprising:

a cross member, wherein the cross member has a top face, a first contact surface and a second contact surface, and a bottom face;

a first clamp arm and a second clamp arm, extending generally perpendicularly to the cross member, and extending generally parallel to each other, wherein the first and the second clamp arms have an inner face and an outer face, and wherein a plurality of support members connectively couple proximal ends of the first and second clamp arms to opposite ends of the cross member; and a first retaining tab extending perpendicularly from the inner face of the first clamp arm proximal to a distal end of the first clamp arm, and a second retaining tab extending perpendicularly from the inner face of the second clamp arm proximal to a distal end of the second clamp arm, wherein the first and the second retaining tabs extend partially across a roughly U-shaped region defined by the cross member, and the inner faces of the first and second clamp arms; wherein the clamp is a single-body structure formed by plastic-based injection-molding techniques.

11. The cable strain relief clamp of claim 10, wherein the bottom face of the cross member has a curved cable cutout guide for ensuring a secure engagement with a coaxial cable.

12. The cable strain relief clamp of claim 10, wherein the first and second clamp arms cooperate with the first and second contact surfaces of the cross member and the first and second retaining tabs to engage a cable housing.

13. The cable strain relief clamp of claim 12, wherein the first and second retaining tabs are spaced apart from the bottom face of the cross member by a distance X along the first and second clamp arms, wherein distance X corresponds to the thickness of the cable housing.

14. The cable strain relief clamp of claim 12, wherein when the cable strain relief clamp is engaged with the cable housing, the first and second clamp arms, the first and second retaining tabs, and the first and second contact surfaces of the cross member are in contact with the cable housing.

15. The cable strain relief clamp of claim 10, wherein the first and second retaining tabs have a bottom engagement face generally angled relative to the first and second retaining tabs and the first and second clamp arms allowing engagement with a cable housing.

16. The cable strain relief clamp of claim 15, wherein when the cable strain relief clamp is engaged with the cable housing, the cross member exerts a force on a coaxial cable and retains the cable between the cross member and the cable housing.

17. The cable strain relief clamp of claim 10, wherein the plastic-based injection moulding techniques comprise making the cable strain relief clamp of high-viscosity copolymer acetal.

18. The cable strain relief clamp of claim 10, wherein the cross member is concave relative to the first and second clamp arms.

19. A phase shifter assembly, comprising:

a first phase shifter sub-assembly, the first phase shifter sub-assembly including a first phase shifter carrier, a first phase shifter printed circuit board mounted on the first phase shifter carrier, a first wiper printed circuit board coupled to an input of the first phase shifter printed circuit board and having at least a first end coupled to a plurality of transmission lines on the first phase shifter printed circuit board, and at least one first wiper support mechanically coupling the first wiper printed circuit board to the first phase shifter printed circuit board;

wherein the first phase shifter carrier includes cable-receiving sections, including a first plurality of cable recesses dimensioned to receive a first plurality of cables and a first plurality of recesses for receiving a first plurality of cable strain relief clamps;

a second phase shifter sub-assembly, the second phase shifter sub-assembly including a second phase shifter carrier, a second phase shifter printed circuit board mounted on the second phase shifter carrier, a second wiper printed circuit board coupled to an input of the second phase shifter printed circuit board and having at least one end coupled to transmission lines on the second phase shifter printed circuit board, and at least one second wiper support mechanically coupling the second wiper printed circuit board to the second phase shifter printed circuit board, wherein the second phase shifter carrier includes cable-receiving sections, including a second plurality of cable recesses dimensioned to receive a second plurality of cables and a second plurality of recesses for receiving a second plurality of cable strain relief clamps; and a pivot arm rotatably mounted in the phase shifter assembly and being configured to engage at least one of the first and second wiper supports, the pivot arm further having a slot oriented substantially parallel to a longitudinal axis of the pivot arm;

wherein each one of the plurality of the cable strain relief clamps comprise:

a. a cross member, wherein the cross member has a top face, a first contact surface and a second contact surface, and a bottom face;

b. a first clamp arm and a second clamp arm, extending generally perpendicularly to the cross member, and extending generally parallel to each other, wherein the first and the second clamp arms have an inner face and an outer face, and wherein a plurality of support members connectively couple proximal ends of the first and second clamp arms to opposite ends of the cross member; and c. a first retaining tab extending perpendicularly from the inner face of the first clamp arm proximal to a distal end of the first clamp arm, and a second retaining tab extending perpendicularly from the inner face of the second clamp arm proximal to a distal end of the second clamp arm, wherein the first and the second retaining tabs extend partially across a roughly U-shaped region defined by the cross member, and the inner faces of the first and second clamp arms.

20. A phase shifter assembly, comprising:

a first phase shifter sub-assembly, the first phase shifter sub-assembly including a first phase shifter carrier, a first phase shifter printed circuit board mounted on the first phase shifter carrier, a first wiper printed circuit board coupled to an input of the first phase shifter printed circuit board and having at least a first end coupled to transmission lines on the first phase shifter printed circuit board, and at least one first wiper support mechanically coupling the first wiper printed circuit board to the first phase shifter printed circuit board;

wherein the first phase shifter carrier includes cable-receiving sections, including a first plurality of cable recesses dimensioned to receive a first plurality of cables and a first plurality of recesses for receiving a first plurality of cable strain relief clamps; wherein each one of the plurality of the cable strain relief clamps comprise:

a. a cross member, wherein the cross member has a top face, a first contact surface and a second contact surface, and a bottom face;

b. a first clamp arm and a second clamp arm, extending generally perpendicularly to the cross member, and extending generally parallel to each other, wherein the first and the second clamp arms have an inner face and an outer face, and wherein a plurality of support members connectively couple proximal ends of the first and second clamp arms to opposite ends of the cross member; and c. a first retaining tab extending perpendicularly from the inner face of the first clamp arm proximal to a distal end of the first clamp arm, and a second retaining tab extending perpendicularly from the inner face of the second clamp arm proximal to a distal end of the second clamp arm, wherein the first and the second retaining tabs extend partially across a roughly U-shaped region defined by the cross member, and the inner faces of the first and second clamp arms; wherein the clamp is a single-body structure formed by plastic-based injection molding techniques.

21. The phase shifter assembly of claim 20, wherein the phase shifter assembly comprises a second phase shifter sub-assembly, the second phase shifter sub-assembly including a second phase shifter carrier, a second phase shifter printed circuit board mounted on the second phase shifter carrier, a second wiper printed circuit board coupled to an input of the second phase shifter printed circuit board and having at least one end coupled to transmission lines on the second phase shifter printed circuit board, and at least one second wiper support mechanically coupling the second wiper printed circuit board to the second phase shifter printed circuit board, wherein the second phase shifter carrier includes cable-receiving sections, including a second plurality of cable recesses dimensioned to receive a second plurality of cables and a second plurality of recesses for receiving a second plurality of cable strain relief clamps.

22. The phase shifter assembly of claim 21, wherein the phase shifter assembly comprises a pivot arm rotatably mounted in the phase shifter assembly and being configured to engage at least one of the first and second wiper supports, the pivot arm further having a slot oriented substantially parallel to a longitudinal axis of the pivot arm.

23. The phase shifter assembly of claim 21, wherein the phase shifter assembly comprises a throw arm mounted to the phase shifter assembly to allow linear movement of the throw arm, the throw arm further having a pin that engages the slot of the pivot arm such that when the throw arm is moved linearly, the pivot arm rotates around a pivot.

* * * * *